US010640339B2

(12) United States Patent
Martin et al.

(10) Patent No.: US 10,640,339 B2
(45) Date of Patent: May 5, 2020

(54) MOBILE CRANE AND METHOD FOR ANGLING A MAIN JIB EXTENSION RELATIVE TO A MAIN JIB OF A MOBILE CRANE

(71) Applicant: Terex Global GmbH, Schaffhausen (CH)

(72) Inventors: Michael Martin, Illingen (DE); Traugott Fess, Bechhofen (DE); Roland Kuhn, St. Ingbert (DE)

(73) Assignee: Terex Global GmbH, Schaffhausen (CH)

( * ) Notice: Subject to any disclaimer, the term of this patent is extended or adjusted under 35 U.S.C. 154(b) by 0 days.

(21) Appl. No.: 15/774,738

(22) PCT Filed: Nov. 8, 2016

(86) PCT No.: PCT/EP2016/077002
§ 371 (c)(1),
(2) Date: May 9, 2018

(87) PCT Pub. No.: WO2017/081021
PCT Pub. Date: May 18, 2017

(65) Prior Publication Data

US 2018/0346291 A1 Dec. 6, 2018

(30) Foreign Application Priority Data

Nov. 10, 2015 (DE) ..... 10 2015 119 379

(51) Int. Cl.
*B66C 23/70* (2006.01)
*B66C 23/68* (2006.01)
*B66C 23/82* (2006.01)

(52) U.S. Cl.
CPC ..... *B66C 23/702* (2013.01); *B66C 23/68* (2013.01); *B66C 23/82* (2013.01); *B66C 23/701* (2013.01); *B66C 2700/0392* (2013.01)

(58) Field of Classification Search
CPC ..... B66C 23/68; B66C 23/701; B66C 23/702; B66C 23/82
See application file for complete search history.

(56) References Cited

U.S. PATENT DOCUMENTS 3,085,695 A * 4/1963 Miller ..... B66C 23/70 212/177
4,394,941 A 7/1983 Privat
(Continued)

FOREIGN PATENT DOCUMENTS

CN 1138005 A 12/1996
CN 2364010 Y 2/2000
(Continued)

OTHER PUBLICATIONS

Machine Translation of JP-S60100390 (Year: 1985).*
(Continued)

*Primary Examiner* — Michael R Mansen
*Assistant Examiner* — Juan J Campos, Jr.
(74) *Attorney, Agent, or Firm* — Garner, Linn, Burkhart & Ondersma LLP

(57) ABSTRACT

A mobile crane having a main jib that is mounted thereupon for luffing and that can be oriented by means of a luffing cylinder, and a main jib extension that is detachably connected to a main jib head of the main jib by means of upper and lower bolts, it being possible to angle the main jib extension about a luffing axis relative to the main jib proceeding from a base position following release of the upper or lower bolts and using an angle drive, the angle drive engaging with a foot of the main jib extension, a maximum
(Continued)

angling angle being delimited by an adjustable angling plate, and the angling plate engaging with the foot of the main jib extension and the main jib head. The angle drive may be a component of an angling plate in the form of a combi-angling plate.

11 Claims, 10 Drawing Sheets

(56) References Cited

U.S. PATENT DOCUMENTS

| | | | | | |
|---|---|---|---|---|---|
| 4,653,655 | A | * | 3/1987 | Rathi | B66C 23/702 212/177 |
| 4,828,124 | A | | 5/1989 | Iga | |
| 5,842,587 | A | * | 12/1998 | Wanek | B66C 23/82 212/177 |
| 9,056,752 | B2 | | 6/2015 | Müler et al. | |
| 9,090,436 | B2 | | 7/2015 | Franzen et al. | |
| 9,272,883 | B2 | | 3/2016 | Behnke | |
| 2005/0011850 | A1 | * | 1/2005 | Hinrichs | B66C 23/702 212/300 |
| 2005/0098524 | A1 | * | 5/2005 | Irsch | B66C 13/18 212/300 |
| 2010/0213152 | A1 | * | 8/2010 | Martin | B66C 23/18 212/177 |
| 2010/0294738 | A1 | * | 11/2010 | Martin | B66C 23/344 212/347 |
| 2010/0329773 | A1 | * | 12/2010 | Martin | B66C 23/702 403/3 |
| 2017/0066632 | A1 | | 3/2017 | Hegewald | |
| 2018/0044149 | A1 | | 2/2018 | Weckbecker et al. | |
| 2018/0327234 | A1 | | 11/2018 | Martin et al. | |
| 2018/0339889 | A1 | | 11/2018 | Kuhn et al. | |
| 2018/0346292 | A1 | | 12/2018 | Kuhn et al. | |

FOREIGN PATENT DOCUMENTS

| | | | | | |
|---|---|---|---|---|---|
| CN | 101628691 | A | | 1/2010 | |
| CN | 101687618 | A | | 3/2010 | |
| CN | 201458603 | U | | 5/2010 | |
| CN | 101830403 | A | | 9/2010 | |
| CN | 102862921 | A | | 1/2013 | |
| CN | 103359636 | A | | 10/2013 | |
| CN | 102602825 | B | | 7/2014 | |
| DE | 291531 | A5 | | 7/1991 | |
| DE | 202004020760 | U1 | | 1/2006 | |
| DE | 10321493 | B4 | | 7/2006 | |
| DE | 102009010452 | A1 | | 9/2010 | |
| DE | 102012023814 | A1 | | 6/2014 | |
| DE | 102014003831 | A1 | | 9/2015 | |
| EP | 1081088 | A1 | | 3/2001 | |
| EP | 2253576 | A1 | | 11/2010 | |
| FR | 2075866 | A1 | | 10/1971 | |
| FR | 2719574 | A1 | | 11/1995 | |
| GB | 1470488 | A | | 4/1977 | |
| GB | 2081210 | A | | 2/1982 | |
| JP | S60100390 | U | | 7/1985 | |
| JP | S60100390 | | * | 9/1985 | B66C 23/68 |
| JP | H09104588 | A | | 4/1997 | |

OTHER PUBLICATIONS

Machine Translation of JP-H09104588 (Year: 1997).*

Preliminary Report on Patentability of the International Searching Authority in English from corresponding Patent Cooperation Treaty (PCT) Application No. PCT/EP2016/077002, completed May 15, 2018.

International Search Report of the International Searching Authority from corresponding Patent Cooperation Treaty (PCT) Application No. PCT/EP2016/077002, indicated completed on Feb. 13, 2017.

Written Opinion of the International Searching Authority from corresponding Patent Cooperation Treaty (PCT) Application No. PCT/EP2016/077002, indicated completed on Feb. 13, 2017.

* cited by examiner

B-B
6b
6c
6d
6f

T
H
6e
6i
6d
B
B
6g
6k
6j
6
d
6q
6p
T
6e
6b
H
6i
6d
6m
6k
6j
6l
6n
6p
6q

6

MOBILE CRANE AND METHOD FOR ANGLING A MAIN JIB EXTENSION RELATIVE TO A MAIN JIB OF A MOBILE CRANE

CROSS REFERENCE TO RELATED APPLICATIONS

The present application claims the priority benefits of International Patent Application No. PCT/EP2016/077002, filed Nov. 8, 2016, and claims benefit of German patent application DE 10 2015 119 379.5, filed Nov. 10, 2015.

BACKGROUND OF THE INVENTION

The invention relates to a mobile crane comprising a main jib which is mounted in a luffable manner thereon and can be raised by means of a luffing cylinder, and comprising a main jib extension which is releasably connected to a main jib head of the main jib by means of upper and lower bolts, the main jib extension, proceeding from a basic position after release of the upper or lower bolts, can be angled relative to the main jib about a luffing axis by means of an angling drive, the angling drive engages a foot of the main jib extension, a maximum angling angle is limited by an adjustable angling plate and the angling plate engages the foot of the main jib extension and the main jib head.

The invention also relates to a method for angling a main jib extension relative to a main jib of a mobile crane.

The German utility model DE 20 2004 020 760 U1 already discloses a mobile crane comprising a main jib and a main jib extension which is fastened to its main jib head. The main jib extension can be luffed from a basic position, in which the main jib extension is oriented with its longitudinal direction in extension of the longitudinal direction of the main jib, to a 20° position and a 40° position. Typically, the main jib extension is releasably fastened to the main jib head by means of two lower bolts arranged in the region of bottom chords of the main jib extension and by means of two upper bolts arranged in the region of top chords of the main jib extension. In order to be able to luff the main jib extension out of the basic position about the lower two bolts serving as a luffing axis, in a first step the two upper bolts are withdrawn and in a second step the luffing of the main jib extension is effected by means of hydraulic luffing cylinders which engage the main jib head and the main jib extension. The two upper bolts are inserted and withdrawn in each case by means of a hydraulic bolting cylinder. In order to supply power to the luffing cylinders and the bolting cylinders, an autarkical hydraulic unit is arranged on the lower end of the main jib extension. The hydraulic unit used can be e.g. a diesel motor or electric motor each having an associated hydraulic pump.

German patent document DE 103 21 493 B4 discloses a mobile crane comprising a main jib extension and an angling plate. The angling plate is designed as a mechanically lockable telescopic apparatus having a tubular guiding plate and a sliding plate which is guided and extendible therein and is likewise tubular. The guiding plate has stop openings for receiving bolts which serve to support the sliding plate at its lower end and thus permit a preselected length of the angling plate and thus angular adjustment of the main jib extension. The angling plate is arranged in the region of a bottom chord of the main jib and the main jib extension. The desired angling is achieved by raising the main jib, whereby the angling plate is reduced in length until the sliding plate impinges upon the bolt and is supported thereon.

Moreover, European patent application EP 2 253 576 A1 discloses another embodiment of an angling plate for angling a main jib extension of mobile cranes. The angling plate which is formed from two angle levers has, in its basic position which corresponds to a 0° position of the main jib extension with respect to the main jib, several pairs of aligned stop openings for bolts. By selecting one pair of the stop openings for the bolts, the length of the angling plate can be varied and the main jib extension can be fixed in various angular positions, preferably 0°, 20° and 40°. The actual angular movement of the main jib extension is effected by means of a lifting machine located on the crane or next to the crane.

SUMMARY OF THE INVENTION

The present invention provides a mobile crane and a method for angling a main jib extension relative to a main jib of a mobile crane, by means of which the angling of the main jib extension is simplified.

In accordance with the invention, in the case of a mobile crane comprising a main jib which is mounted in a luffable manner thereon and can be raised by means of a luffing cylinder, and comprising a main jib extension which is releasably connected to a main jib head of the main jib by means of upper and lower bolts, the main jib extension, proceeding from a basic position after release of the upper or lower bolts, can be angled relative to the main jib about a luffing axis by means of an angling drive, the angling drive engages a foot of the main jib extension, a maximum angling angle is limited by an adjustable angling plate and the angling plate engages the foot of the main jib extension and the main jib head, a simplification is achieved by virtue of the fact that the angling drive is a component of an angling plate in the form of a combi-angling plate. In an advantageous manner, a known passive, mechanically limiting angling plate is converted into a hydraulically supported combi-angling plate which also provides the mechanical limitation. By integrating the angling drive into the combi-angling plate, it is not necessary to provide any additional force transmission points on the main jib head or the main jib extension. The angling per se is effected as far as possible on the ground or at the storage position of the main jib so that it is not necessary to work far above the upper edge of the mobile crane. The invention permits angling of the main jib extension in a mobile crane which stands on flat ground and has a horizontally oriented telescopic jib. For the last part of the luffing of the main jib extension to a 20° or 40° position, the luffing cylinder of the main jib is used. Since the extension path of the hydraulic cylinder of the angling drive can be freely selected, the angling drive can be configured relatively independently of the terrain when the extension path is selected to be longer.

Since the combi-angling plate engages in the region of the foot of the main jib extension, a fork head offset, which compensates for a deformation of the main jib extension, is not required between the main jib and main jib extension. It is particularly important in the case of long slender jib systems. As a result, it is also not necessary to provide an auxiliary cylinder, by means of which a fork head offset must be compensated for.

Preferably, provision is made that the angling drive engages the main jib head on the one hand and engages the main jib extension on the other hand. In particular, the angling drive is designed in this case such that the main jib extension can be raised and lowered so as to pivot about the luffing axis against the effect of the gravitational force of the main jib extension.

In one advantageous embodiment, provision is made that the main jib extension, proceeding from a basic position after release of the upper bolts, can be angled about a luffing axis in the region of a bottom chord of the main jib extension by means of the angling drive, and the angling drive engages in the region of the top chord of the main jib extension.

It is particularly advantageous that the angling drive is designed as a hydraulic cylinder having a housing and rod.

In one structurally simple and advantageous embodiment, provision is made that the combi-angling plate consists of a sliding plate, a guiding plate and the angling drive, the angling drive drivingly engages the sliding plate on the one hand and the guiding plate on the other hand and the sliding plate can be displaced relative to the guiding plate by means of the angling drive. In particular, the angling drive in this case is releasably fastened to the sliding plate. In a particularly preferred manner, the sliding plate is pivotably mounted on the main jib head, the guiding plate is pivotably mounted on the main jib extension, the sliding plate is guided in the guiding plate and a maximum displacement of the sliding plate in the guiding plate can be limited by means of a stop bolt.

In accordance with the invention, in the case of a method for angling a main jib extension relative to a main jib of a mobile crane, in particular a mobile crane as described above, wherein the main jib is mounted in a luffable manner on the mobile crane and can be raised by means of a luffing cylinder, the main jib extension is releasably connected to a main jib head of the main jib by means of upper and lower bolts, an angling drive engages a foot of the main jib extension, a maximum angling angle is limited by an adjustable angling plate and the angling plate engages the foot of the main jib extension and the main jib head, a simplification is achieved by virtue of the fact that by means of the angling drive which is a component of an angling plate in the form of a combi-angling plate, the main jib extension, proceeding from a basic position, is raised relative to the main jib about a luffing axis as far as until the upper or lower bolts are relieved, then the upper or lower bolts are removed, at least one combi-angling plate is inserted, or has already been inserted, between the main jib head and a top chord or bottom chord of the main jib extension, the main jib extension is lowered by means of the angling drive for as long as until the maximum angular position is reached or a head of the main jib extension comes to rest on a ground, the angling drive is drivingly separated from the combi-angling plate and if the maximum angular position is not yet reached, the main jib is raised in order to angle the main jib extension until the desired angling angle is achieved. With regard to the advantages associated with this, reference is made to the previous statements relating to the mobile crane.

Preferably, provision is made that the main jib extension, proceeding from a basic position, is raised relative to the main jib about a luffing axis as far as until the upper bolts are relieved, then the upper bolts are removed, at least one combi-angling plate is inserted, or has already been inserted, between the main jib head and a top chord of the main jib extension.

In the context of the present invention, a mobile crane is understood to be both a movable telescopic crane and a movable crawler crane comprising a lattice mast jib.

The invention will be explained in greater detail hereinafter with reference to an exemplified embodiment illustrated in the drawings.

DESCRIPTION OF THE PREFERRED EMBODIMENTS

Figure 1:
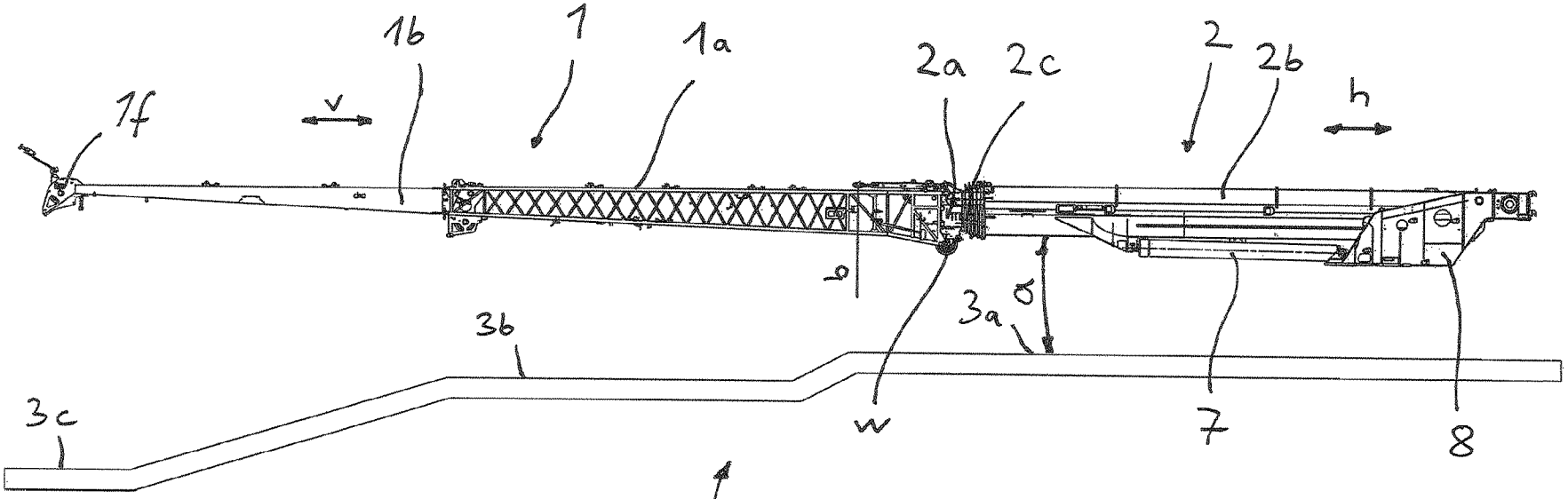
FIG. 1 shows a side view of a main jib extension in a basic position on a main jib.

FIG. 1 illustrates a side view of a main jib extension 1 in a basic position on a main jib 2. The main jib 2 is designed as a telescopic jib comprising a basic box 2*b* and corresponding telescopic sections 2*c*. A main jib head 2*a* is provided at the free end of the innermost telescopic section 2*c*. The main jib 2 is a component of telescopic crane, not illustrated, and typically can be raised by means of a hydraulic luffing cylinder 7 which is supported on a superstructure 8 of the telescopic crane. In FIG. 1, the superstructure 8 is indicated only by a frame part thereof. In FIG. 1, the main jib extension 1 and the main jib 2 are shown in a so-called stored position in which the main jib extension 1 with its longitudinal direction v and the main jib 2 with its longitudinal direction h are oriented substantially horizontally. Therefore, a so-called luffing angle a of the main jib 2 relative to the superstructure 8 is 0° in the stored position. The raising of the main jib 2 relative to the superstructure 8 is described by the luffing angle a. The main jib extension 1 is releasably fastened to the main jib head 2*a* by means of a bolt connection. The main jib extension 1 can be used temporarily or continuously with the telescopic crane in order to achieve an even greater total length of the jib which goes beyond the largest jib length of the main jib 2.

This main jib extension 1 is divided into a basic jib 1*a* which is designed as a lattice mast and typically has a truss pipe construction, and a tip 1*b* which adjoins said basic jib and is designed as a box jib. In FIG. 1, the main jib 2 and the main jib extension 1 are located in a 0° position or basic position in which the longitudinal direction h of the main jib 2 and the longitudinal direction v of the main jib extension 2 are aligned with one another or extend in parallel with one another. A corresponding angling angle b is therefore 0°. The main jib extension 1 can be luffed with respect to the main jib 2 about a luffing axis w which is formed by a lower rolling head spindle. In this basic position, the main jib extension 1 is spaced apart from a ground 3 having first to third ground levels 3*a* to 3*c* and is thus supported on the main jib head 2*a* by the main jib 2 via the bolt connections in corresponding bolting locations A, B, C and D (see FIG. 2).

Basically, such main jib extensions 1 are constructed as modular systems from individual main elements and can be assembled depending upon the requirement of the length or load-bearing capacity thereof. The individual main elements have dimensions allowing transportation and in most cases are not also carried with the telescopic crane but instead are transported separately. If the axle loads of the telescopic crane and the installation size of the main jib extension 1 allow, the main jib extension 1 can also be carried if required. This would then be located in a transport position laterally next to and in parallel with the main jib 2. The individual main elements are connected to one another by means of bolt connections to form the desired main jib extension 1. The attachment to the main jib head 2*a* can be effected using main elements or as a preassembled unit or units.

Figure 2:
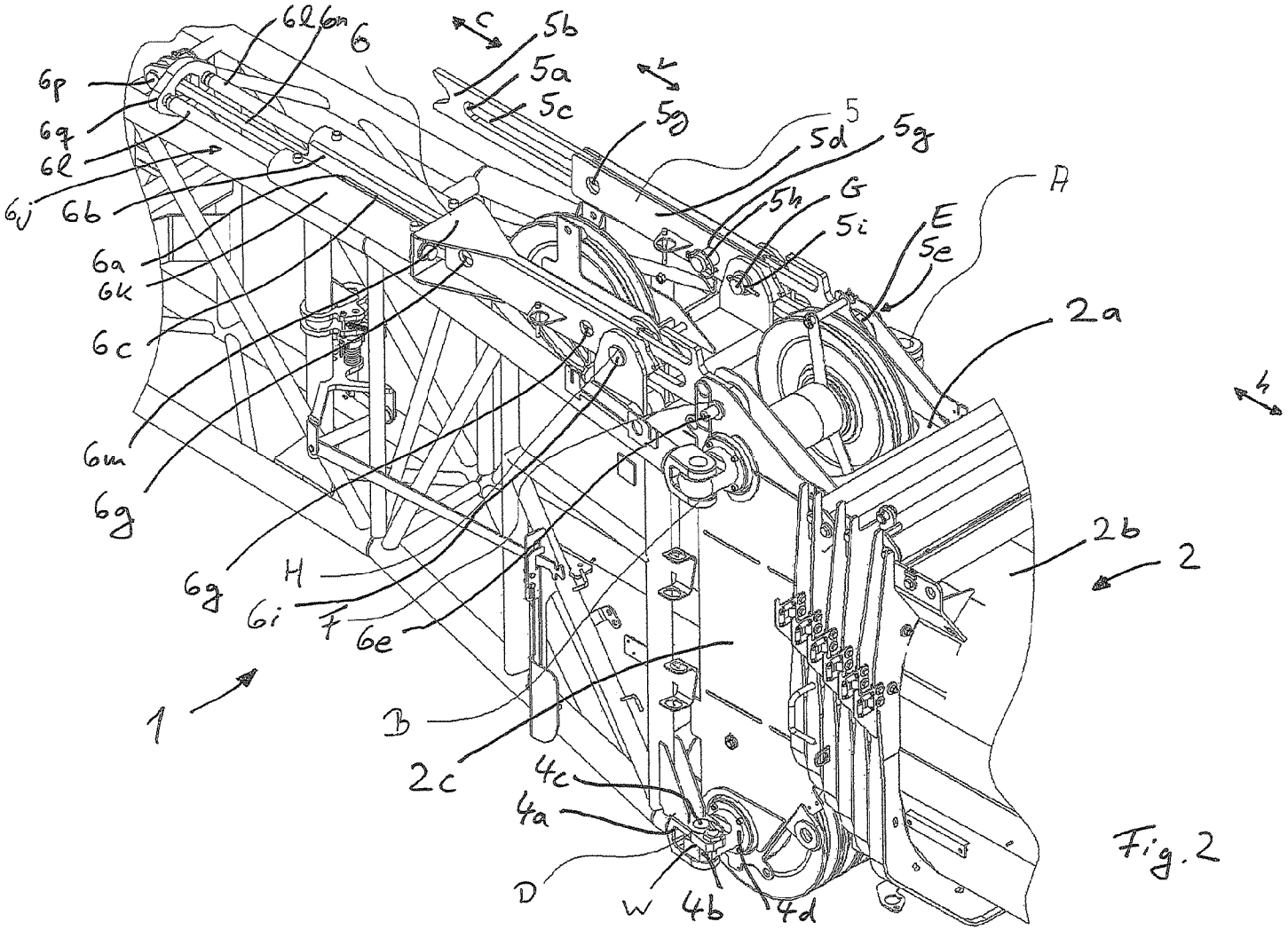
FIG. 2 shows a detailed view of FIG. 1 from the region where the main jib extension is coupled to the main jib.

FIG. 2 shows a detailed view of FIG. 1 from the region where the main jib extension 1 is coupled to the main jib 2. The main jib extension 1 which typically has a rectangular cross-section is fastened to the main jib 2 by means of four bolt connections, which are arranged in the corner regions of the main jib extension 4, at bolting points A, B, C and D. The lower right bolt connection at the bolting point C is concealed by the main jib 2 but is identical to the bolt connection at the bolting point D. Each of the four bolt connections is designed as a so-called double-shear bolt connection which is correspondingly constructed substantially from a fork plate 4*a*, a plate 4*b* and a bolt 4*c*. The fork plate 4*a* with its two opposite bores for the bolt 4*c* is fastened in each case in the four bolting points A to D to the foot is of the main jib extension 1 and in extension of the main jib extension 1. In this case, the bores in the fork plate 4*a* are oriented vertically when the main jib extension 1 is horizontal. The plate 4*b* is fastened to the main jib head 2*a* by means of a spindle 4*d*. When the main jib head 2*a* is oriented horizontally, the spindle 4*d* is oriented horizontally and transversely to the longitudinal direction of the main jib 2 and is rotatably mounted in the main jib head 2*a*. In a corresponding manner, each plate 4*b* is also rotatable about the horizontal spindle 4*d*. The plate 4*b* also has a bore which is aligned with the bores of the fork plate 4*a*. A bolt 4*c* is inserted into the bores of the plate 4*b* and the fork plate 4*a* in order to fasten the main jib extension 1 to the main jib head 2*a* in a corresponding manner.

In order to be able to angle the main jib extension 1 relative to the main jib head 2*a* or main jib 2, provision is made to withdraw the two upper bolts 4*c* at the bolting points A and B in the region of a top chord 1*d* of the main jib extension 1 so that the main jib extension 1 can be angled relative to the main jib 2 about the lower spindle 4*d* in the region of the lower bolting points C and D in the region of a bottom chord 1*e* of the main jib extension 1 about the angling angle b. The lower spindle 4*d* thus forms the luffing axis w. Instead of the spindle 4*d*, the bolts 4*c* could also be used if they were aligned horizontally. The angling angle b is typically in the range of 0° to 40°. In order to limit the angling angle b or to be able to set it to the typical angling angle values of 20° and 40°, two so-called angling plates 5 are provided, one of which is designed as an active combi-angling plate 6. The angling plate 5 and the combi-angling plate 6 extend in the region of the longitudinal sides of the top chord 1*d* of the main jib extension 1 and in parallel with one another.

The passive angling plate 5, by means of which a displacement path and therefore the angling angle b can be manually limited by means of a stop surface 5*a*, consists substantially of a sliding plate 5*b* having a long hole-shaped guiding opening 5*c*, at which a guiding plate 5*d* can be guided in the longitudinal direction c along a sliding plate 5*b*. The sliding plate 5*b* is designed as an elongated flat profile having the stop opening 5*c* and extends substantially in parallel with the longitudinal direction v of the main jib extension 1. At an end facing the main jib head 2*a*, the sliding plate 5*b* has a bore, via which the sliding plate 5*b* is releasably fastened to the main jib head 2*a* at the bolting point E by means of a bolt 5*e*. The bolt 5*e* is oriented with its longitudinal extension in parallel with the spindle 4*d*. Slid onto the sliding plate 5*b* is the guiding plate 5*d* which for this purpose has a closed rectangular cross-section with a guiding opening 5*f* (see FIG. 5), into which the sliding plate 5*b* is inserted and displaceably guided. The guiding plate 5*d* per se is releasably fastened to the basic jib 1*a* of the main jib extension 1 at an end facing the main jib head 2*a* by means of a further bolt 5*i* in a bolting point G. The bolt 5*i* is oriented with its longitudinal extension in parallel with the spindle 4*d*. In this case, the bolt 5*i* is also guided through the stop opening 5*c* of the sliding plate 5*b*. In order to limit a displacement of the guiding plate 5*d* on the sliding plate 5*b*, two stop bores 5*g* which are continuous and spaced apart from one another in the longitudinal direction of the guiding plate 5*d* are arranged in the side parts of the guiding plate 5*d*. A first one of the two stop bores 5*g* serves to limit the angling angle b to 20° and a second one of the stop bores serves to limit the angling angle to 40°. The stop bores 5*g* for 40° are accordingly arranged closer to the main jib head 2*a* in order to permit a larger displacement path. Depending upon the desired angling angle b, the respective stop bore 5*g* has a stop bolt 5*h* inserted therein which then extends through the two opposite stop bores 5*g* and the stop opening 5*c* located therebetween. In FIG. 2, the stop bolt 5*h* is inserted into the second one of the two stop bores 5*g* which limits the angling angle b to 40°. The stop bolt 5*h* is guided next to the bolt 5*i* in the stop opening 5*c*. The bolt 5*i* would only come into contact with the opposite stop surface 5*a* of the stop opening 5*c* if no stop bolt 5*h* is inserted. The second one of the two stop openings 5*g* is free.

The active combi-angling plate 6 is comparable in terms of the structure of the manual part with the above-described passive angling plate 5 and correspondingly has a stop surface 6*a*, a sliding plate 6*b*, a stop opening 6*c*, a guiding plate 6*d*, a bolt 6*e*, a guiding opening 6*f*, a stop bore 6*g*, a stop bolt 6*h* which corresponds to the stop bolt 5*h* and is also defined as a bolt 6*p*, and a bolt 6*i*. In the exemplified embodiment, the stop bolt 6*h* and the bolt 6*p* are the same and are provided with different terms and reference signs only in relation to their insertion location. Two bolts can also be provided next to one another but the function of the active combi-angling plate 6 does not provide a simultaneous use of the stop bolt 6*h* and bolt 6*p* which means that only one bolt can be provided for this purpose. The bolt 6*e* is releasably fastened to the main jib head 2*a* in a bolting point F and the bolt 6*i* is releasably fastened thereto at a bolting point H. The stop bolt 6*h* is not inserted in the basic position with the angling angle b of 0°.

Compared with the passive angling plate 5, the active combi-angling plate 6 is supplemented by a drive 6*j* in order to be able to actively displace the guiding plate 6*d* relative to the sliding plate 6*b*. For this purpose, the sliding plate 6*d* is provided, at its end opposite the main jib head 2*a*, with an angle bracket 6*m*, at which the angling drive 6*j* consisting of two hydraulic cylinders extending mutually in parallel and having housings 6*k* and a rod 6*l* are connected on the housing side. The hydraulic cylinders extend in the c longitudinal direction of the angling plate 5 or combi-angling plate 6. In order to connect the angling drive 6*j* or the hydraulic cylinders extending mutually in parallel and having its rods 6*l* to the sliding plate 6*b* of the combi-angling plate 6, the sliding plate 6 is extended with respect to the passive angling plate 5 by a rod part 6*n* in order to form an abutment for the angling drive 6*j*. Arranged at the end of the rod part 6*n* opposite the main jib head 2*a* is a bore 6*o* (see FIG. 3) in order to fasten a coupling part 6*q* via a further bolt 6*p*, the rods 6*l* of the hydraulic cylinders or angling drives 6*j* being mounted at said coupling part. The hydraulic cylinders can be connected e.g. to existing hydraulic circuits. Basically, the hydraulic circuit of a cylinder used for horizontally pivoting an entrained main jib extension out of a transport position is suitable for this purpose.

The angling drive 6*j* is dimensioned such that only the empty weight of the main jib extension 1 can be angled down or up.

Figure 3:
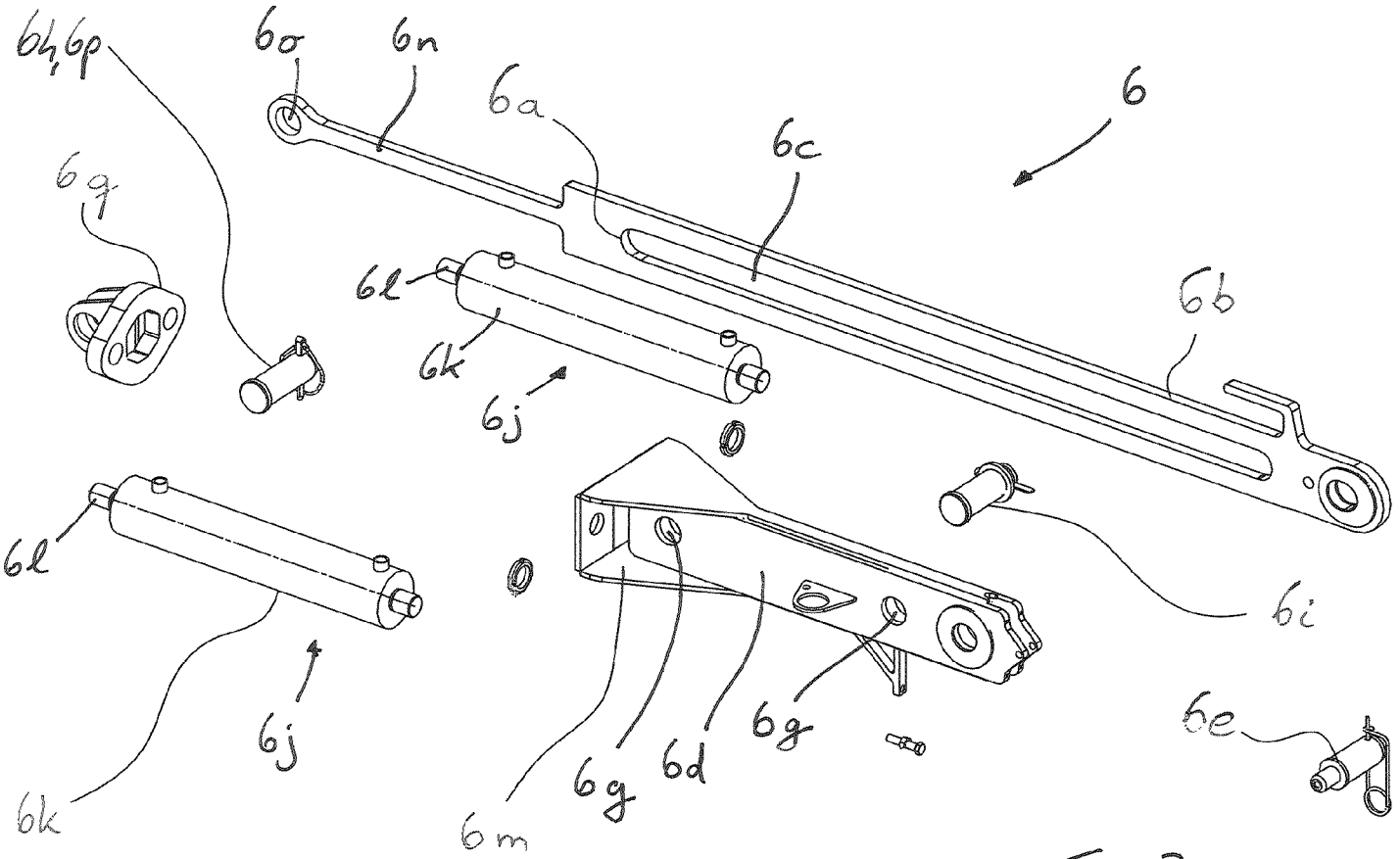
FIG. 3 shows an exploded view of a combi-angling plate of FIG. 2.

FIG. 3 shows an exploded view of a combi-angling plate of FIG. 2. It can be seen that the coupling part 6*q* has a total of three bores in order to receive the bolt 6*p* and the ends of the rods 6*l* of the angling drive 6*j* and therefore to divert the force between the sliding plate 6*b* and the guiding plate 6*d*. FIG. 3 also illustrates the stop bolt 6*h*.

Figures 4A, 4B, 5:
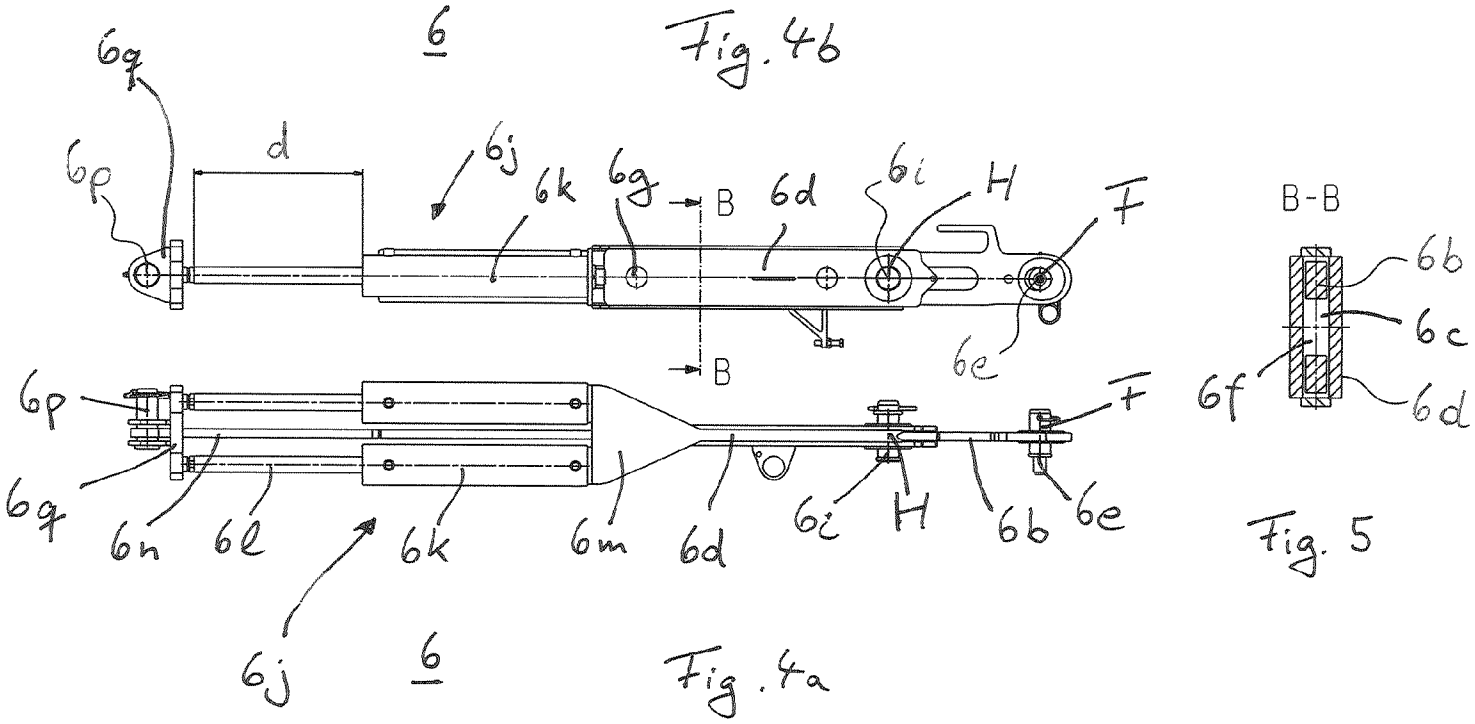
FIG. 4*a* shows a detailed view of a combi-angling plate in the position shown in FIG. 1.
FIG. 4*b* shows a side view of FIG. 4*a;*
FIG. 5 shows a sectional view of FIG. 4*b* taken along section line B-B.

FIG. 4*a* illustrates a detailed view of a combi-angling plate 6 in the position shown in FIG. 1. It can be seen that the angling drive 6*j* is extended, i.e. the rod 6*l* is moved out of the housing 6*k* by the distance of an extension path d. This extension path d corresponds to the basic position, illustrated in FIG. 1, between the main jib extension 1 and the main jib 2. The angling drive 6*j* can be extended even further in order to reduce the spaced interval between the bolting points G, H and E, F. This then results in the upper bolts 4*c* at the bolting points A, B being relieved. Moreover, the angling drive 6*j* is coupled to the sliding plate 6*b* because the bolt 6*p* is inserted.

FIG. 4*b* shows a side view of FIG. 4*a* with the extension path d indicated.

FIG. 5 illustrates a sectional view of FIG. 4*b* taken along section line B-B. It can be seen that the guiding plate 6*d* has a rectangular cross-section having a central guiding opening 6*f*, in which the sliding plate 6*b* with its stop opening 6*c* is guided.

The angling of the main jib extension 1, which is located in the basic position shown in FIG. 1, to a 40° position will be explained hereinafter with reference to FIGS. 1 to 9, in particular FIGS. 6 to 9. In a first step, the angling plate 5 and the combi-angling plate 6 are fastened to the main jib head 2*a* in the bolting points E and F by means of the bolts 5*e* and 6*e*. Then, the angling drive 6*j* is actuated and the rods 6*l* of the hydraulic cylinders are extended until the sliding plate 6*b* is withdrawn relative to the guiding plate 6*d* in the direction of the main jib extension 1 by means of the coupling part 6*q* so that the spaced interval between the bolting points G, H and E, F is reduced and the main jib extension 1 pivots slightly upwards via the spindles 4*d* of the bolting points C, D, which spindles are arranged in the region of the bottom chord 1*d*. As a result, the main jib extension 1 is raised slightly so that the upper bolts 4*c* on the top chord 1*d* of the main jib extension 1 are relieved in the bolting points A, B. The now relieved bolts 4*c* are then removed. The main jib extension 1 is now supported on the main jib 2 by means of the two lower bolts 4*c* in combination with the combi-angling plate 6. The two lower bolts 4*c* or the spindle 4*d* which is also a rolling head spindle thus form the luffing axis w for the purpose of angling the main jib extension 1.

In a next step, the angling drive 6*j* is again actuated and the rods 6*l* of the hydraulic cylinders are slowly retracted. As a result, the sliding plate 6*b* is slid relative to the guiding plate 6*d* in the direction of the main jib 2 via the coupling part 6*q* so that the spaced interval between the bolting points G, H and E, F is increased and the main jib extension 1 pivots about the angling angle b via the spindle 4*d* of the bolting points C, D arranged in the region of the bottom chord 1*d*. By reason of this angling movement, the head 1*f* of the main jib extension 1 is lowered in the direction of the ground 3 until it contacts the ground 3. The angling drive 6*j* is then retracted slightly further, whereby the bolt 6*p* in the bore 6*o* is relieved and is then transferred as a stop bolt 6*h* to the stop bore 6*g*. This has the advantage that, during the setting-up procedure, it is not forgotten to decouple the angling drive 6*j* and the angling drive is no longer involved in the main flow of forces when a load is being lifted. The desired maximum displacement path is also set at the angling plate 5 previously or at the latest at the present time in order to permit or limit the angling of the main jib extension 1 to the 20° position or 40° position.

Figure 6:
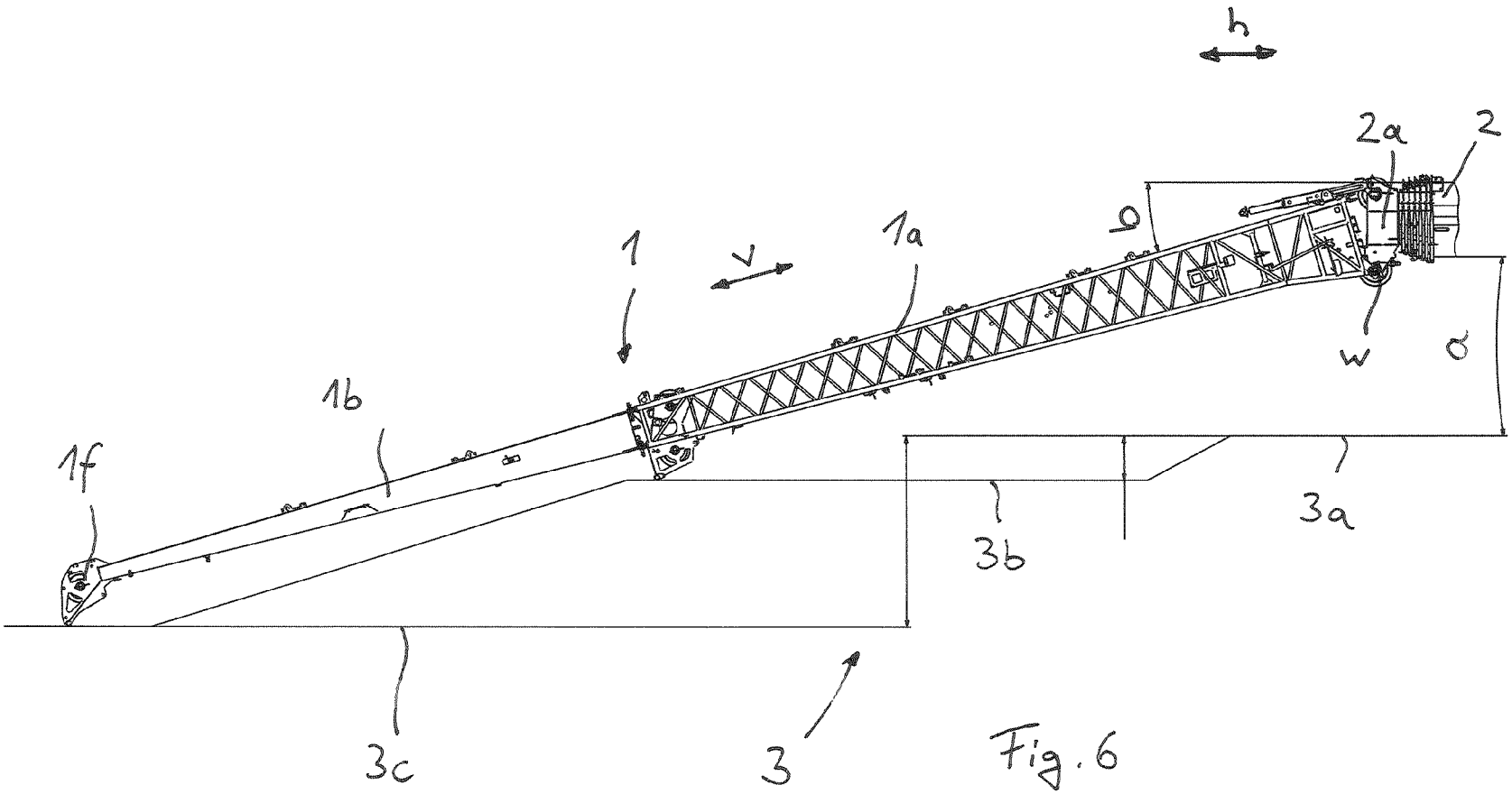
FIG. 6 shows the main jib of FIG. 1 with the main jib extension in a 15° position.

FIG. 6, showing the main jib extension 1 of FIG. 1 in a 15° position, shows the previously described position in which the lowered head 1*f* is supported on the ground 3. The luffing angle a of the main jib 2 is still 0°.

Figures 7A, 7B:
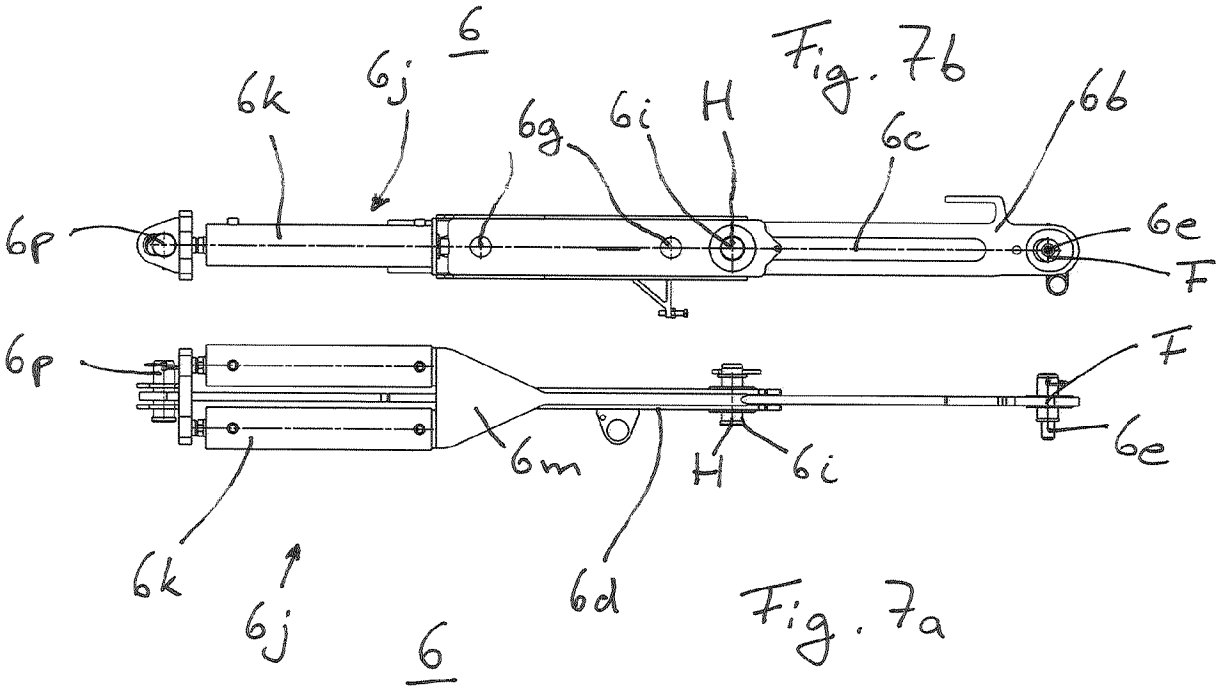
FIG. 7*a* shows a detailed view of a combi-angular plate in the position shown in FIG. 6.
FIG. 7*b* shows a side view of FIG. 7*a;*

FIG. 7*a* shows a detailed view of the combi-angling plate 6 in the 15° position shown in FIG. 6. It is shown that the rods 6*l* of the hydraulic cylinder are completely retracted and the coupling part 6*q* is still connected to the rod part 6*n* of the sliding plate 6*b* by means of the bolt 6*p*. Now, because the tip 1*f* is resting on the ground 3 the bolt 6*p* is withdrawn and therefore the angling drive 6*j* is released from the combi-angling plate 6 which therefore also becomes a passive angling plate.

FIG. 7*b* shows a side view of FIG. 7*a*.

Figure 8:
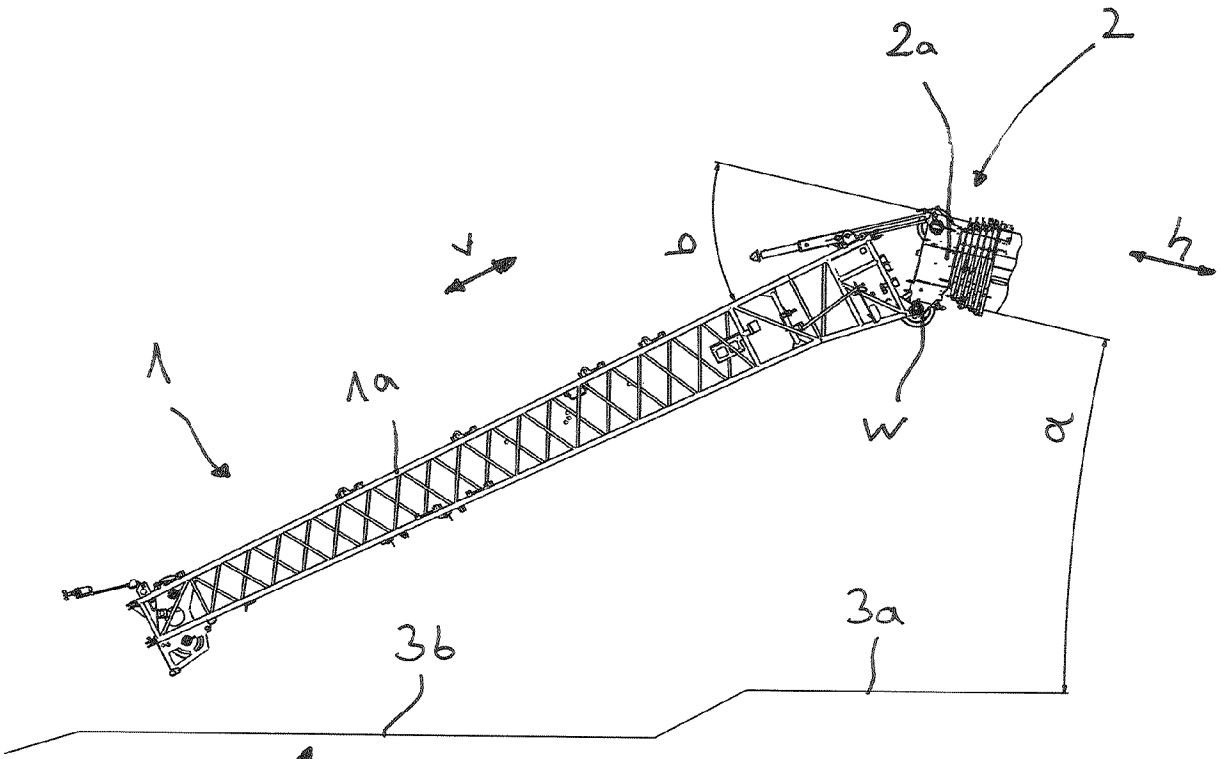
FIG. 8 shows the main jib of FIG. 1 with the main jib extension in a 40° position.

In a further step, by luffing the main jib 2 about the luffing angle a the main jib extension 1 is angled further and the tip 1*f* of the main jib extension 1 slides therethrough across the ground 3 in the direction of the main jib 2. By means of the luffing action, the main jib extension 1 is angled further for as long as until the angling plate 5 and the combi-angling plate 6 limit the angling in a preselected position. At the point in time the angling movement is limited in the 40° position by the angling plate 5 and the combi-angling plate 6, the tip 1*f* is still just about in contact with the ground 3. During further luffing of the main jib 2, the main jib extension 1 lifts from the ground 3 in the 40° position. This position, in which the main jib extension 1 is located in a 40° position with respect to the main jib 2, is illustrated in FIG. 8. For reasons of clarity, the tip 1*b* of the main jib extension 1 is not shown therein.

Figures 9A, 9B:
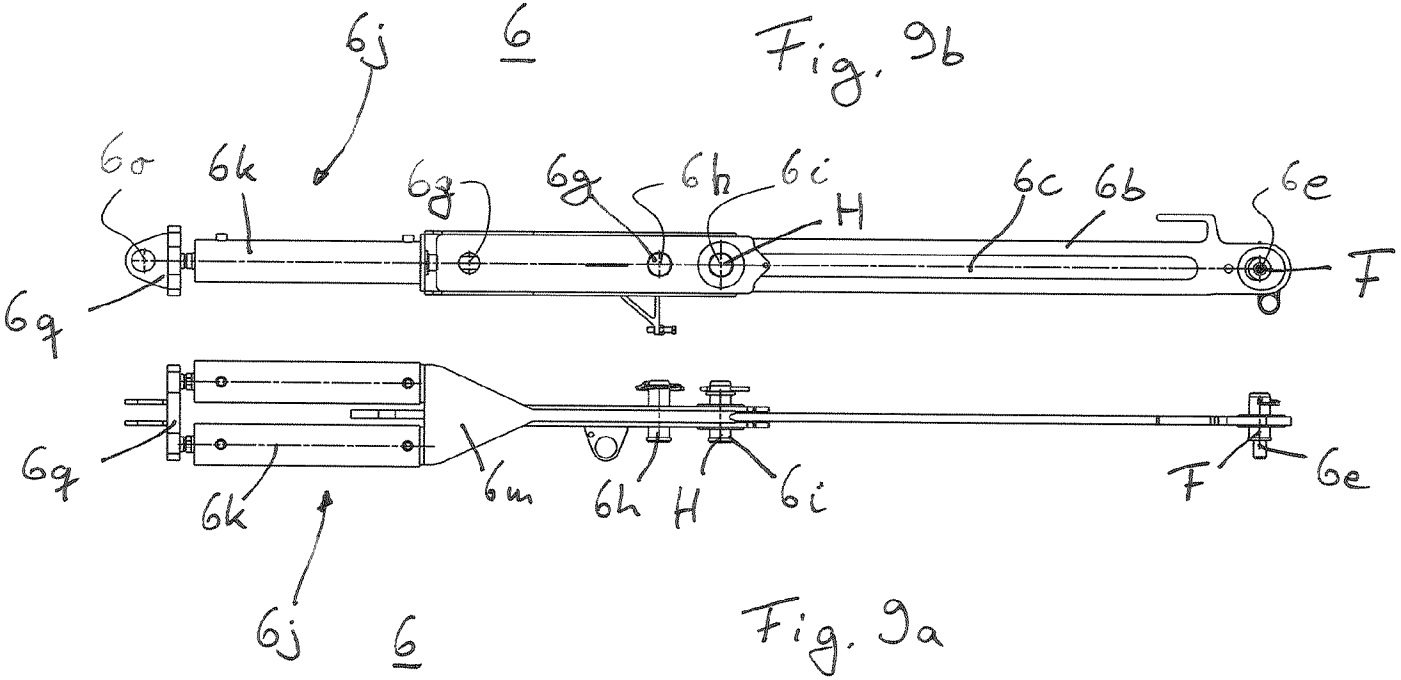
FIG. 9*a* shows a detailed view of a combi-angling plate in the position shown in FIG. 8.
FIG. 9*b* shows a side view of FIG. 9*a;*

FIG. 9*a* illustrates a detailed view of a combi-angling plate 6 in the position shown in FIG. 8. The stop bolt 6*h* is inserted in the stop bore 6*g* which faces the main jib head 2*a* in order thus to limit the maximum displacement possibility of the guide plate 6*d* on the sliding plate 6*b*. The stop bolt 6*h* lies against the stop surface 6*a* at the end of the stop opening 6*c*. Since the stop bolt 6*h* is inserted into the stop bore 6*g* which is closer to the main jib head 2*a*, the angling angle b is limited to 40°. Moreover, the angling drive 6*j* is still decoupled because the bolt 6*p* is not inserted.

FIG. 9*b* shows a side view of FIG. 9*a*.

Back-fitting or angling-up the main jib extension 1 is performed in the reverse sequence.

Figure 10:
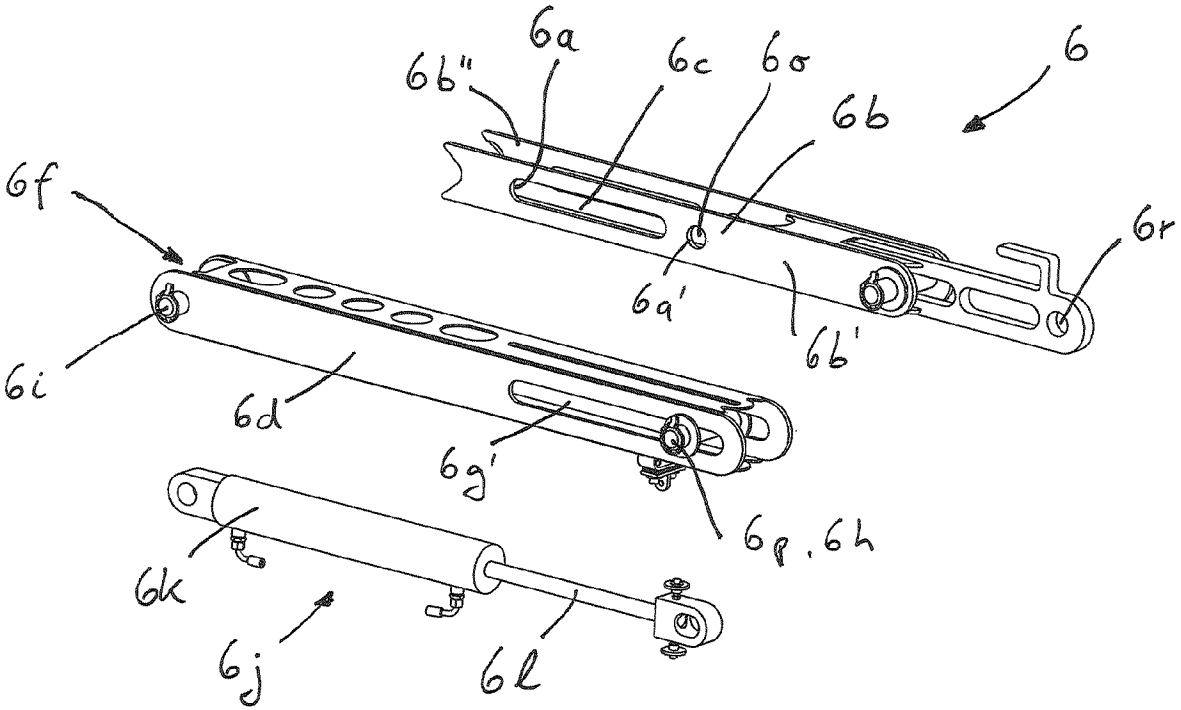
FIG. 10 shows an exploded view of a combi-angling plate in an alternative embodiment.

FIG. 10 illustrates an exploded view of a combi-angling plate 6 in an alternative embodiment which is currently preferred. The active combi-angling plate 6 is comparable in design to the previously described active combi-angling plate 6 and correspondingly has a sliding plate 6*b*, a guiding plate 6*d* and an angling drive 6*j*.

The substantial difference in this alternative sliding plate 6*b* compared with the previously described sliding plate 6*b* is that this sliding plate 6*b* is not flat profile-shaped over its entire length but instead is formed, at least in the region of the stop opening 6*c* and the bore 6*o*, from two flat profile-shaped sliding plate parts 6*b*', 6*b*" which extend in parallel and spaced apart from one another in order to receive therebetween the angling drive 6*j* which is designed as a hydraulic cylinder. The sliding plate 6*b* also has, in addition to the stop opening 6*c*, a bore 6*o* in the region of its centre in order to releasably connect the rod 6*l* of the angling drive 6*j* to the sliding plate 6*b* by means of the bolt 6*p*. This bore 6*o* is also used as a stop surface 6*a*' for the stop bolt 6*h* or bolt 6*p* in the 20° position. The further bolt which is shown in FIG. 10 but does not have a reference sign does not have any function. The associated bore can be used for storing bolts which are not being used at that time.

The guiding plate 6*d* shown in FIG. 10 is comparable to the previously described guiding plate, wherein the guiding opening 6*f* is correspondingly wider in order to receive the wider sliding plate 6*b*. Instead of two stop bores 6*g* in the guiding plate 6*d*, only one long hole-shaped stop opening 6*g*' is provided. In order to achieve the desired angling of the main jib extension in the 20° and 40° position, the sliding plate 6*b* has not only a stop opening 6*c* but also the additional bore 6*o*. The illustrated bolt 6*p*, 6*h* can be used either to connect the angling drive 6*j* to the sliding plate 6*b* or to limit the displacement of the guiding plate 6*d* along the sliding plate 6*b*.

FIG. 10 also illustrates the angling drive 6*j* in the form of an individual hydraulic cylinder having a housing 6*k* and rod 6*l*. At the free end of the rod 6*l*, the hydraulic cylinder can be connected to the bore 6*o* of the sliding plate 6*b* by means of the bolt 6*p* as required. At the opposite end, the housing 6*k* of the hydraulic cylinder is connected together with the guiding plate 6*d* in the stop point H on a plate of the foot 1*c* of the main jib extension 1 to the bolt 6*i*. In contrast to the view in FIG. 2, the plate will be arranged further removed from the main jib head 2*a* because the flow of forces through the combi-angling plate 6 shown in FIG. 10 differs from the combi-angling plate 6 in FIG. 2.

Figures 11A, 11B:
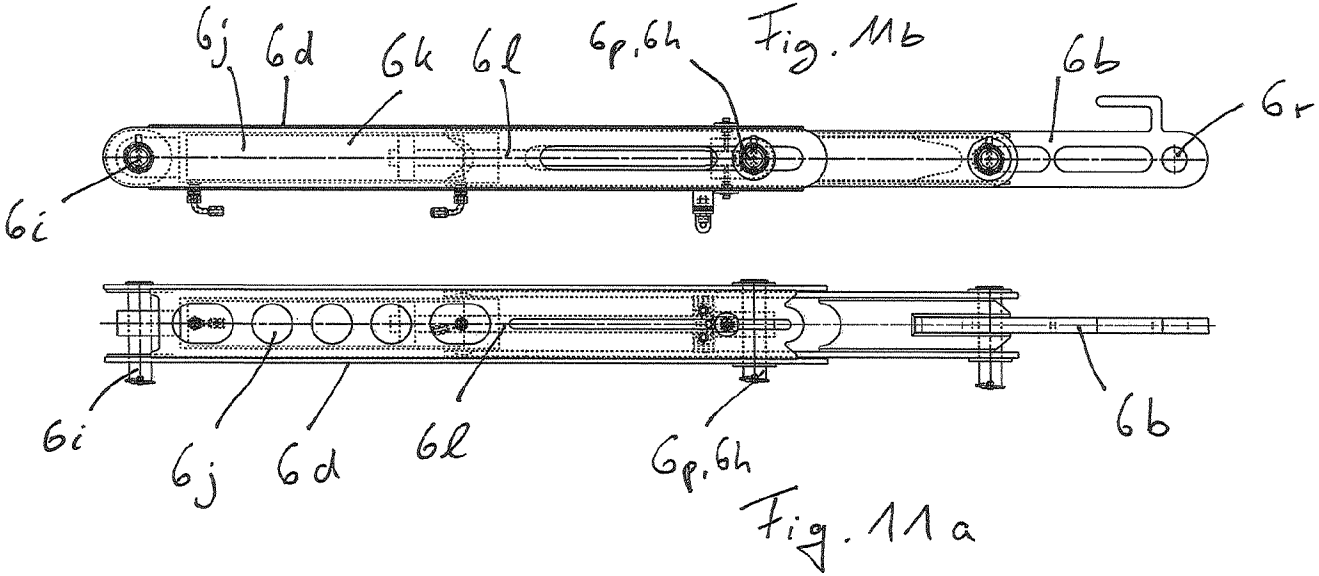
FIG. 11*a* shows a detailed view of an assembled combi-angling plate shown in FIG. 10.
FIG. 11*b* shows a side view of FIG. 11*a*.

FIG. 11*a* shows a detailed view of an assembled combi-angling plate 6 shown in FIG. 10. It can be seen that the angling drive 6*j* is arranged in the sliding plate 6*b* between the two sliding plate parts 6*b*' and 6*b*". The sliding plate parts 6*b*' and 6*b*" are correspondingly guided in the guiding opening 6*f* of the guiding plate 6*d*. In accordance with the interleaved design, the sliding plate 6*b* can be displaced relative to the guiding plate 6*d* by means of the coupled angling drive 6*j* or, when the angling drive 6 is decoupled, by means of the empty weight of the main jib extension 1.

FIG. 11*b* shows a side view of FIG. 11*a*.

Although, in connection with the present exemplified embodiment, the main jib 2 is described as a telescopic jib and the main jib extension 1 is described as a lattice mast jib comprising a box tip, the invention can also be applied to other embodiments of main jib 2 and main jib extension 1. The main jib 2 can also be a lattice mast jib or a combination of telescopic jib, lattice mast jib and/or box jib. Lattice mast jibs or box jibs or combinations thereof are feasible for the main jib extension 1.

Furthermore, the exemplified embodiment relates to the use of an angling plate 5 and a combi-angling plate 6. Instead of providing one angling plate 5 and one combi-angling plate 6, it is also possible to provide two combi-angling plates 6 which are each arranged in the edge region of the top chord 1*d* of the main jib extension 1. This embodiment comprising two combi-angling plates 6 without an angling plate 5 is preferred. The use of a single combi-angling plate 6 which is arranged centrally in relation to the width of the top chord 1*d* of the main jib extension 1 is also feasible. Furthermore, the combi-angling plate 6 has been described up to this point as a tension member. An embodiment as a compression member is also feasible as is the arrangement in the bottom chord region. It is also feasible that the luffing axis w is then arranged in the region of the top chord 1*d*. The foot 1*c* of the main jib extension 1 is correspondingly chamfered, preferably in the form of an adapter, in order to permit angling of the main jib extension 1 about the upper luffing axis w.

The invention claimed is:

1. A mobile crane comprising a main jib which is mounted in a luffable manner thereon and can be raised by means of a luffing cylinder, and comprising:

a main jib extension that is releasably connected to a main jib head of the main jib by upper and lower bolts, wherein the main jib extension, proceeding from a basic position after release of the upper or lower bolts, can be angled relative to the main jib about a luffing axis by an angling drive, wherein the angling drive engages a foot of the main jib extension, and a maximum angling angle is limited by an adjustable angling plate and the angling plate engages the foot of the main jib extension and the main jib head, and wherein the mobile crane further includes a combi-angling plate comprising the angling drive, wherein the angling drive engages the main jib head on the one hand and engages the main jib extension on the other hand, and wherein the combi-angling plate comprises a sliding plate, a guiding plate and the angling drive, the angling drive drivingly engages the sliding plate on the one hand and the guiding plate on the other hand and the sliding plate can be displaced relative to the guiding plate by the angling drive, and wherein the angling drive is releasably fastened to the sliding plate, wherein the sliding plate is pivotably mounted on the main jib head, the guiding plate is pivotably mounted on the main jib extension, the sliding plate is guided in the guiding plate and a maximum displacement of the sliding plate in the guiding plate can be limited by a stop bolt.

2. The mobile crane as claimed in claim 1, wherein the main jib extension, proceeding from a basic position after release of the upper bolts, can be angled about a luffing axis in the region of a bottom chord of the main jib extension by the angling drive, and the angling drive engages in the region of the top chord of the main jib extension.

3. The mobile crane as claimed in claim 2, wherein the angling drive is designed such that the main jib extension can be raised and lowered so as to pivot about the luffing axis against the effect of the gravitational force of the main jib extension.

4. The mobile crane as claimed in claim 3, wherein the luffing axis is formed in the region of the lower bolts.

5. The mobile crane as claimed in claim 4, wherein the angling drive is designed as a hydraulic cylinder having a housing and rod.

6. The mobile crane as claimed in claim 1, wherein the angling drive is designed such that the main jib extension can be raised and lowered so as to pivot about the luffing axis against the effect of the gravitational force of the main jib extension.

7. The mobile crane as claimed in claim 1, wherein the luffing axis is formed in the region of the lower bolts.

8. The mobile crane as claimed in claim 1, wherein the angling drive is designed as a hydraulic cylinder having a housing and rod.

9. A method for angling a main jib extension relative to a main jib of a mobile crane, wherein the main jib is mounted in a luffable manner on the mobile crane and can be raised by a luffing cylinder with the main jib extension being releasably connected to a main jib head of the main jib by upper and lower bolts, wherein an angling drive engages a foot of the main jib extension and a maximum angling angle is limited by an adjustable angling plate and the angling plate engages the foot of the main jib extension and the main jib head, said method comprising:

raising the main jib extension from a basic position relative to the main jib about a luffing axis as far as until the upper or lower bolts are relieved using the angling drive, wherein the mobile crane further comprises a combi-angling plate comprising the angling drive, and wherein the angling drive engages the main jib head on the one hand and engages the main jib extension on the other hand, and wherein the combi-angling plate comprises a sliding plate, a guiding plate and the angling drive, the angling drive drivingly engages the sliding plate on the one hand and the guiding plate on the other hand, and wherein the sliding plate can be displaced relative to the guiding plate by the angling drive, and wherein the angling drive is releasably fastened to the sliding plate, wherein the sliding plate is pivotably mounted on the main jib head, wherein the guiding plate is pivotably mounted on the main jib extension, wherein the sliding plate is guided in the guiding plate and a maximum displacement of the sliding plate in the guiding plate can be limited by a stop bolt;

removing the upper or lower bolts;

inserting at least one combi-angling plate between the main jib head and a top chord or bottom chord of the main jib extension, wherein said inserting may be previously performed;

lowering the main jib extension using the angling drive for as long as until the maximum angular position is reached or a head of the main jib extension comes to rest on a ground;

drivingly separating the angling drive from the combi-angling plate; and raising the main jib if the maximum angular position is not yet reached in order to angle the main jib extension until the desired angling angle is achieved.

10. The method as claimed in claim 9, wherein said raising the main jib extension from a basic position comprises raising the main jib extension relative to the main jib about a luffing axis as far as until the upper bolts are relieved, and wherein said removing the upper or lower bolts comprises removing the upper bolts, and wherein said inserting at least one combi-angling plate comprises inserting at least one combi-angling plate between the main jib head and a top chord of the main jib extension.

11. The method as claimed in claim 10, wherein the main jib extension, proceeding from a basic position after release of the upper bolts, can be angled about a luffing axis in the region of a bottom chord of the main jib extension by the angling drive, and the angling drive engages in the region of the top chord of the main jib extension.

* * * * *